United States Patent [19]

Aoki et al.

[11] Patent Number: 5,001,980

[45] Date of Patent: Mar. 26, 1991

[54] DELIVERY APPARATUS FOR SHEET-FED PRINTING PRESS

[75] Inventors: Toshiyuki Aoki; Toshi Ojima, both of Toride, Japan

[73] Assignee: Komori Printing Machinery Co., Ltd., Tokyo, Japan

[21] Appl. No.: 286,554

[22] Filed: Dec. 19, 1988

[51] Int. Cl.[5] ..... B41M 7/02; B41L 23/22; B41F 23/06

[52] U.S. Cl. ..... 101/424.2; 101/416.1; 118/DIG. 1

[58] Field of Search ..... 101/416.1, 424.2; 118/DIG. 1; 338/68

[56] References Cited

U.S. PATENT DOCUMENTS

| | | | |
|---|---|---|---|
| 2,114,723 | 4/1938 | Paasche | 118/DIG. 1 |
| 4,642,602 | 2/1987 | Maisch et al. | 338/68 |
| 4,807,528 | 2/1989 | Schmoeger et al. | 101/424.2 |

FOREIGN PATENT DOCUMENTS

| | | |
|---|---|---|
| 51-94702 | 7/1976 | Japan . |
| 52-164901 | 12/1977 | Japan . |
| 56-58867 | 5/1981 | Japan . |
| 58-108145 | 6/1983 | Japan . |
| 59-81175 | 5/1984 | Japan . |
| 60-101140 | 7/1985 | Japan . |
| 61-177841 | 11/1986 | Japan . |
| 61-188824 | 11/1986 | Japan . |
| 62-5932 | 1/1987 | Japan . |
| 62-33440 | 2/1987 | Japan . |
| 62-33442 | 2/1987 | Japan . |
| 62-68754 | 3/1987 | Japan . |
| 63-112150 | 5/1988 | Japan . |

*Primary Examiner*—Edgar S. Burr
*Assistant Examiner*—Ren Yan
*Attorney, Agent, or Firm*—Townsend & Townsend

[57] ABSTRACT

A delivery apparatus for a sheet-fed printing press includes a detector, a control unit and a solenoid. The detector detects a moving amount of suction wheels moved by adjustment and generates a signal corresponding to the moving amount. The control unit is connected to the detector and a timing unit of the printing press and generates a signal representing a predetermined length corresponding to the sheet size. The solenoid is located between a powder container and an air source and opens an air path for only a time interval corresponding to the signal supplied from the control unit.

3 Claims, 5 Drawing Sheets

DELIVERY APPARATUS FOR SHEET-FED PRINTING PRESS

BACKGROUND OF THE INVENTION

The present invention relates to a delivery apparatus for conveying printed sheets, and, delivering and stacking the sheets on a stack board in a sheet-fed printing press.

FIG. 8 is a side view showing a main part of a conventional delivery apparatus. Referring to FIG. 8, a pair of right and left delivery chains 5 are looped between a sprocket 2 arranged coaxially with a delivery cylinder opposing a printing cylinder and a sprocket 4 at the front end of a delivery frame 3. A plurality of pairs of gripper shafts are supported by the delivery chains 5 with predetermined intervals therebetween, and a plurality of pairs of gripper devices 6 (to be referred to as grippers 6 hereinafter) are formed on each gripper shaft. Printed sheets 7 are transferred from grippers of the printing cylinder to the grippers 6 of the delivery chains 5 by the delivery cylinder 1 cooperating with the printing cylinder and are conveyed by movement of the delivery chains 5. A stack board 8 is suspended by lifting chains 9 at its four corners below the terminal end of a sheet convey path. The sheets 7 released from the grippers 6 are dropped and stacked on the stack board 8. Reference numeral 10 denotes a jogger for abutting against and aligning the leading edges of the dropped sheets 7. At the terminal end of the conveying path of the sheets 7, a pair of right and left screw shafts 11 are axially supported by the delivery frame 3. A plurality of suction wheels 12 aligned in a sheet widthwise direction are provided to the screw shafts 11 through a suction wheel shaft or the like. Each sheet 7 is chucked at its trailing edge on the circumferential surfaces of the suction wheels 12 and decelerated. Therefore, the sheets 7 kept at high tension can be aligned well when they are dropped. If a sheet size is changed, the screw shafts 11 are rotated to move forward/backward the suction wheels.

In the above delivery apparatus, if printed surfaces of the sheets 7 stacked on the stack board 8 are not satisfactorily dried, offset occurs to degrade the quality of printed products. Therefore, a powder sprayer is conventionally located in the convey path and powders the printed surface of each conveyed sheet to prevent offset. That is, a nozzle pipe 13 having a large number of nozzle holes and extending in the sheet widthwise direction is located in inclined portions of the delivery chains 5 and connected to an air supply source through a solenoid and a powder container (neither of which is shown). As shown in an enlarged side view of FIG. 9, a cam 16 consisting of a stationary cam 14 and a movable cam 15 which can be phase-adjusted in a circumferential direction with respect to the stationary cam 14 is mounted on the shaft of the sprocket 4. A contact member 19 of a limit switch 18 electrically connected to the solenoid and supported by a bracket 17 is in contact with the cam surface of the cam 16. With this arrangement, when the cam 16 rotates together with the sprocket 4, the solenoid is opened/closed at a predetermined timing through the limit switch 18 each time the contact member 19 passes through a large-diameter portion of the cam surface, and the printed surface is powdered while the sheet 7 is conveyed through a corresponding portion of the nozzle pipe 13. If the sheet size is changed, the movable cam 15 is pivoted to increase/decrease a circumferential angle of the large-diameter portion, thereby prolonging/shortening a powdering time.

In the powder sprayer of the conventional delivery apparatus having the above arrangement, however, an operation corresponding to the sheet size is performed by phase adjustment of the cam 16. Therefore, no accurate adjustment can be expected, and it is troublesome to adjust the cam 16 each time the sheet size is changed because the sheet size is frequently changed. In addition, if the powdering time is too short, offset occurs to degrade the quality of printed products. For this reason, the powdering time is usually set longer in consideration of a safety margin. As a result, powder is wasted or scattered to contaminate the printing press or working environment.

SUMMARY OF THE INVENTION

It is, therefore, a principal object of the present invention to provide a delivery apparatus for a sheet-fed printing press, which can largely improve operability and can accurately set a powdering time to reduce a powder amount.

In order to achieve the above object of the present invention, there is provided a delivery apparatus for a sheet-fed printing press including a powdering pipe suspended within a delivery convey path and connected to an air source through a powder container, and a plurality of delivery suction wheels aligned between the powdering pipe and a delivery stack board and moved in a sheet convey direction in accordance with a sheet size, comprising a detector for detecting a moving amount of the suction wheels moved by adjustment and generating a signal corresponding to the moving amount, a control unit, connected to the detector and a timing unit of the printing press, for generating a signal representing a predetermined length corresponding to the sheet size, and a solenoid, located between the powder container and the air source, for opening an air path for only a time interval corresponding to the signal supplied from the control unit.

DETAILED DESCRIPTION OF THE PREFERRED EMBODIMENTS

Embodiments of the present invention will be described in detail below with reference to the accompanying drawings.

Figure 8:
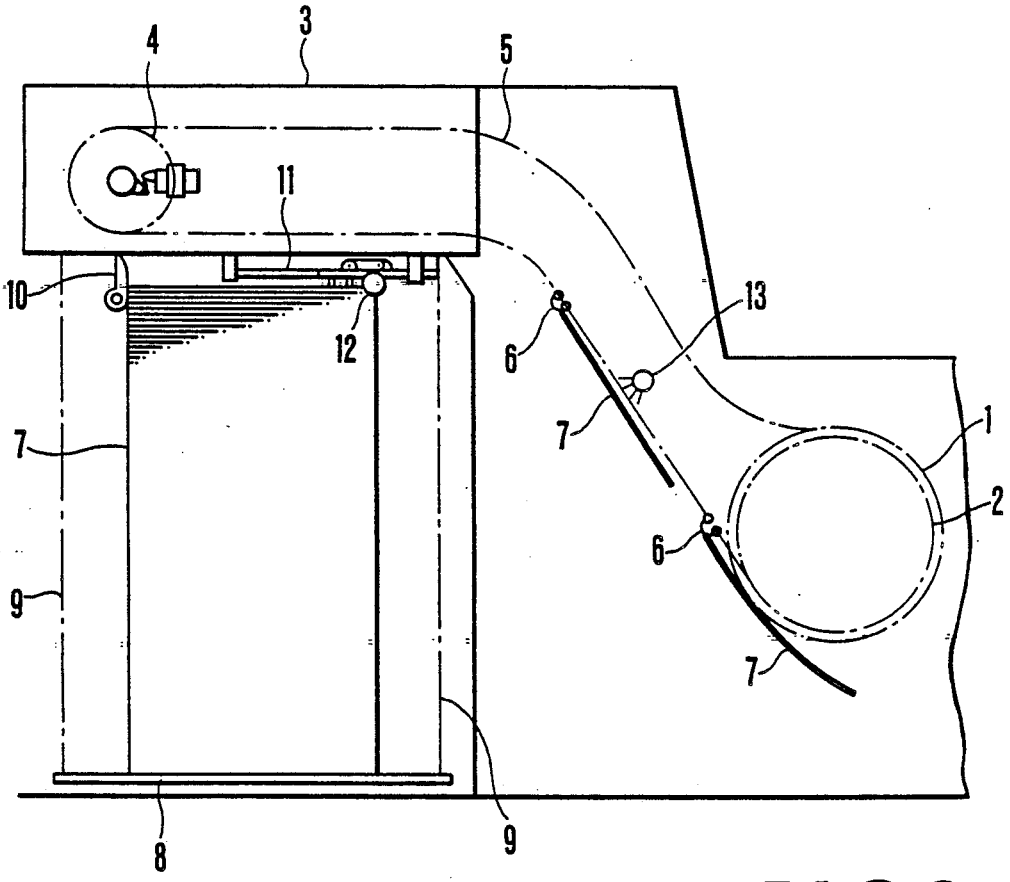
FIG.8 PRIOR ART
FIG. 8 is schematic view showing an arrangement of a conventional delivery apparatus for a sheet-fed printing press.
Figure 9:
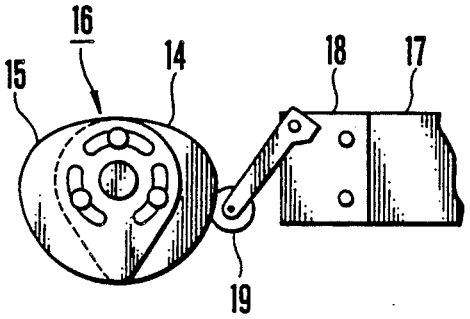
FIG.9 PRIOR ART
FIG. 9 is an enlarged side view showing a suction wheel movement adjusting cam and its peripheral portion of the conventional delivery apparatus.

FIGS. 1 to 5 show a delivery apparatus for a sheet-fed printing press according to an embodiment of the present invention. The arrangement of the overall delivery apparatus is the same as that of the conventional apparatus shown in FIG. 8 except for a suction wheel unit and a powder sprayer, and a detailed description thereof will be omitted unless otherwise specified. The overall arrangement will be described, if necessary, with reference to FIG. 8 hereinafter. The suction wheel unit will be described first. A pair of front and rear brackets 20 are fixed to and extend from right and left delivery frames 3, respectively. A horizontally extending rack 21 is fixed and supported by each bracket 20, and one of a pair of right and left pinions 23 meshes with the corresponding rack 21. A suction wheel shaft 25 is rotatably supported through bushes 26 and 27 by a rectangular support plate 24 for pivotally supporting an operation shaft 22. The shafts 22 and 25 are supported to move forward/backward by rotatably fitting rollers 28 fixed at the shaft end portions in grooves formed in the racks 21. On the suction wheel shaft 25 rotated from a driving side by a chain looped around a sprocket 29 at the shaft end portion, a plurality of suction wheels 30 each having a plurality of suction slits in its circumferential surface are fixed adjacent to air ducts 31 connected to a suction air source. Upon activation of the suction air source, air around the suction wheel 30 is evacuated from the suction slits 30*a* through an air path inside the air duct 31. A handle 32 is axially fixed to the operation shaft 22. When a sheet size is changed, the handle 32 is pivoted to rotate the pinions 23 on the racks 21 so that the shafts 22 and 25, the suction wheels 30 and the like are integrally moved in a longitudinal direction of the sheet 7 to correspond to the sheet size.

Figure 1:
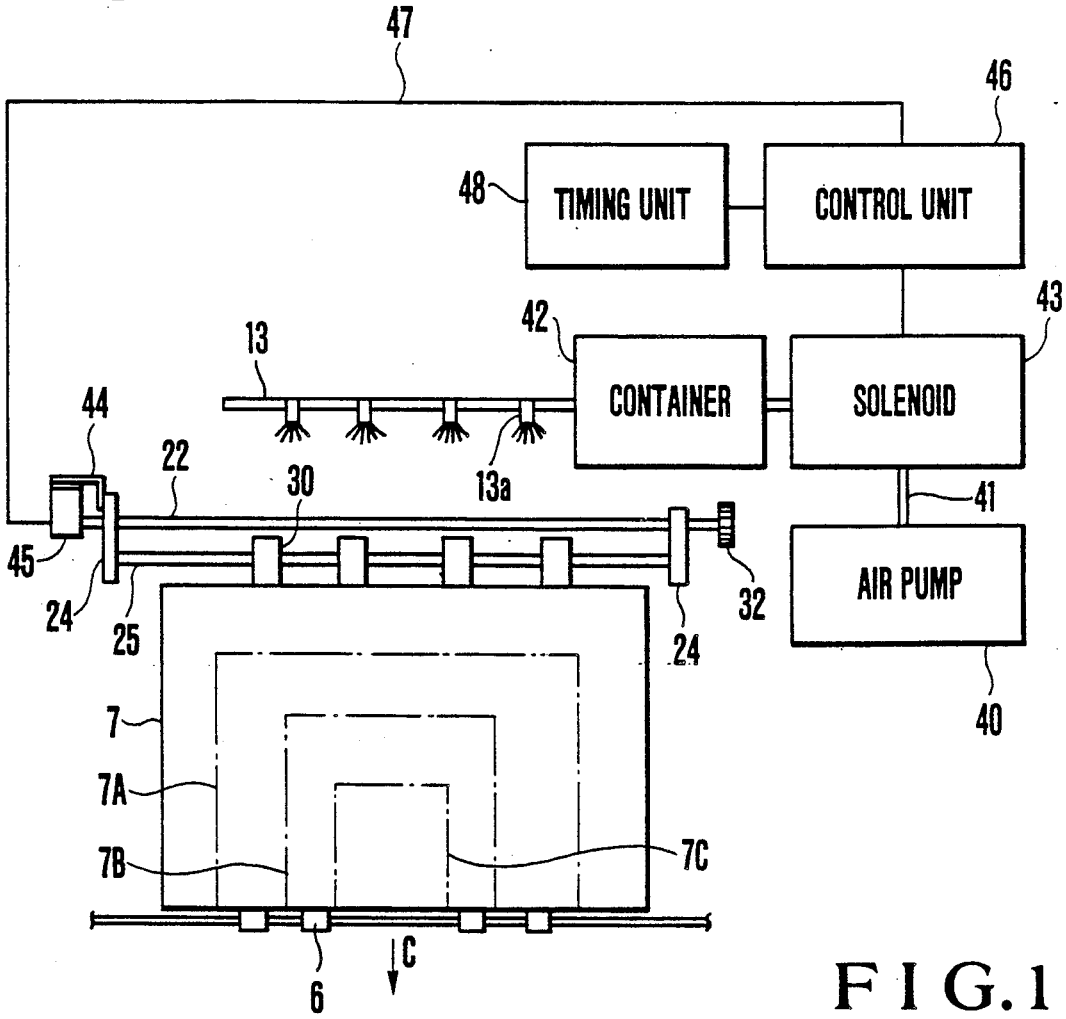
FIG. 1 is a schematic view showing an arrangement of a delivery apparatus for a sheet-fed printing press according to an embodiment of the present invention.
Figure 2:
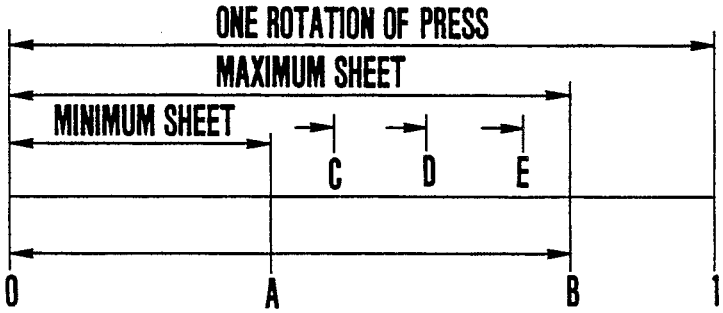
FIG. 2 is a timing chart of the delivery apparatus.
Figure 3:
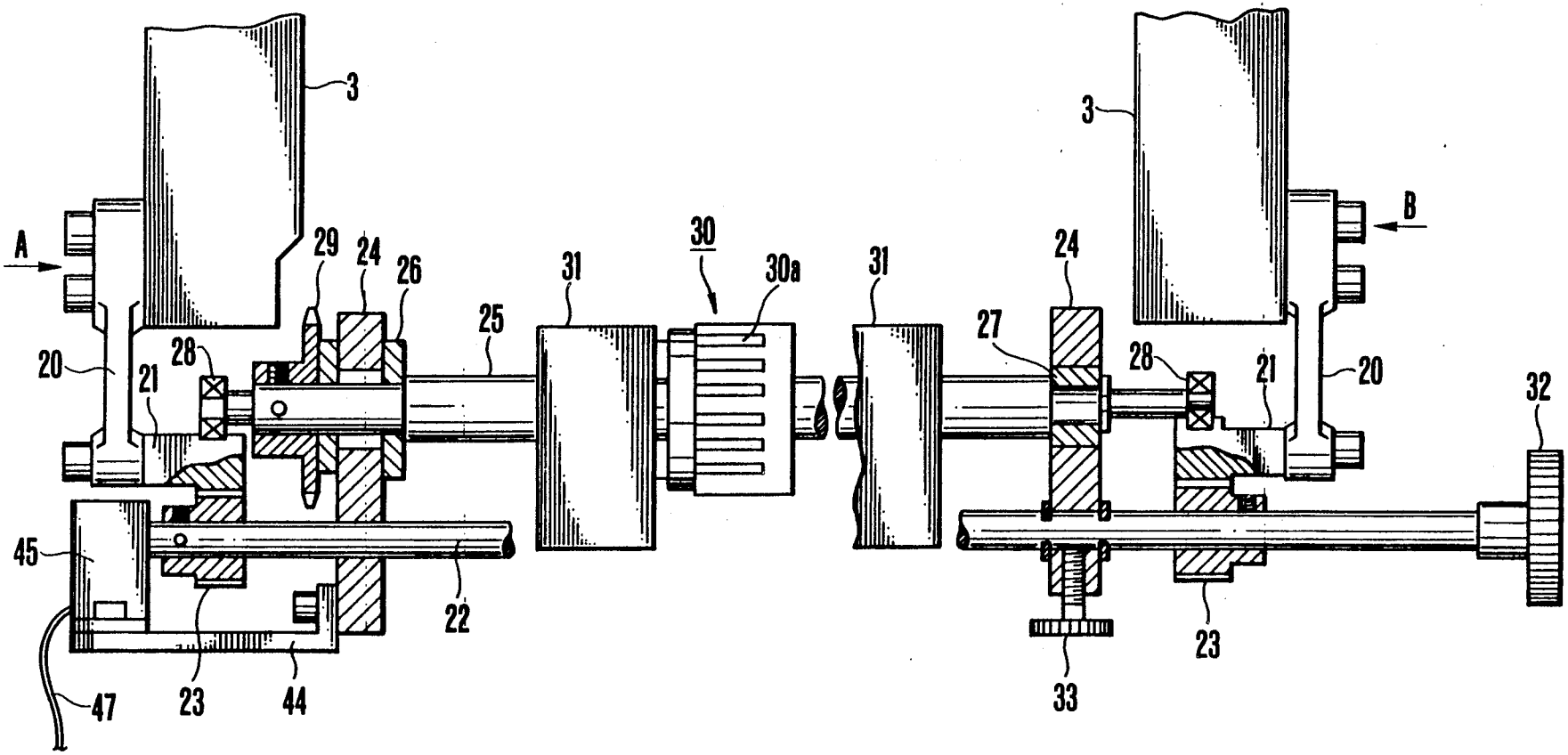
FIG. 3 is a partially cutaway front view showing a suction wheel unit of the delivery apparatus.
Figure 4:
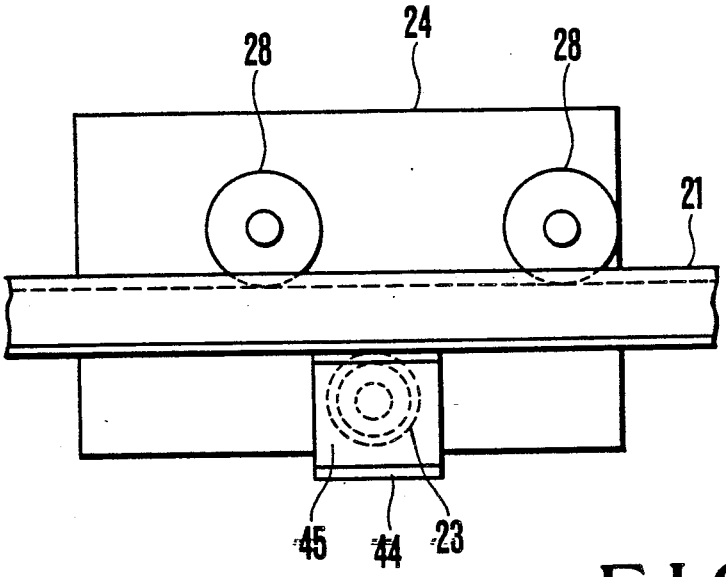
FIG. 4 is a side view of the suction wheel unit viewed from a direction of an arrow A in FIG. 3.
Figure 5:
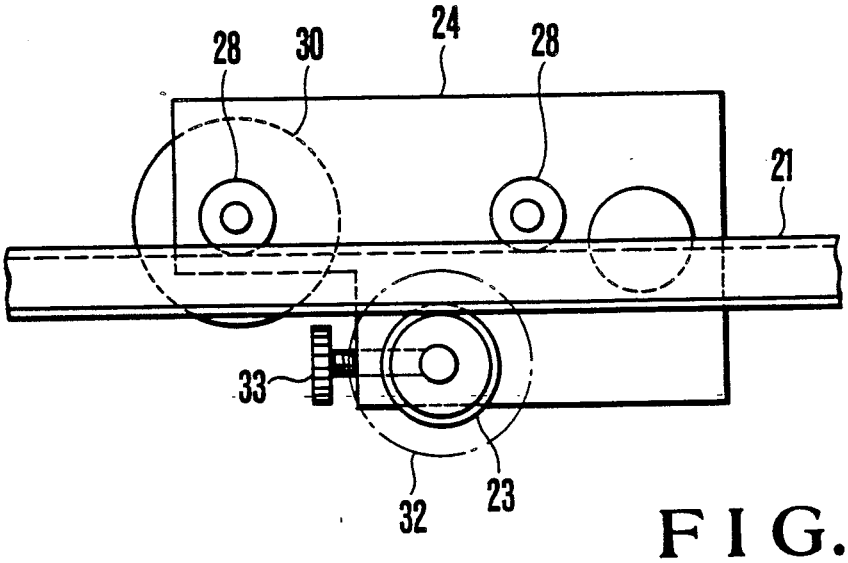
FIG. 5 is a side view of the suction wheel unit viewed from a direction of an arrow B in FIG. 3.

The powder sprayer will be described below. Referring to FIG. 1 which is a plan view showing the arrangement of the delivery apparatus, the suction wheels 30 are aligned in the sheet widthwise direction in the conveying path of the sheet 7 gripped by the grippers 6 and conveyed in a direction indicated by an arrow C. A nozzle pipe 13 as a powdering pipe of the powder sprayer is suspended at the upstream side of the sheet convey path and extends in the sheet widthwise direction. A plurality of air spray holes 13*a* are formed in the nozzle pipe 13. Reference numeral 40 denotes an air pump as a suction air source connected to the nozzle pipe 13 through a pipe 41. A container 42 containing a powder and a solenoid 43 for opening/closing the pipe 41 are located in the pipe 41. A bracket 44 is fixed on one support plate 24 for supporting the suction wheel shaft 25 and the operation shaft 22. A potentiometer 45 as a detector is fixed to the bracket 44 such that its rotating portion is axially mounted on the operation shaft 22. When the operation shaft 22 is pivoted in correspondence with the sheet size, the potentiometer 45 detects a pivoting angle and generates a signal corresponding to the detected angle. The potentiometer 45 and the solenoid 43 are electrically connected to a control unit 46 through a lead wire 47. The control unit 46 is connected to a timing unit 48 for detecting a rotational speed of the printing press and generating a powdering start signal at a predetermined timing. Referring to FIG. 1, reference numeral 7 denotes a maximum sheet; 7C, a minimum sheet; and 7A and 7B, medium sheets, respectively. When the potentiometer 45 detects the sheet size and generates the signal and the timing unit 48 detects the rotational speed of the press and generates the signal, these signals are supplied to the control unit 46 to select a time interval. As a result, a signal is supplied to the solenoid 43 to set a time interval from opening of the valve to closing thereof corresponding to the sheet size. FIG. 2 is a timing chart for explaining the time interval. Referring to FIG. 2, a distance from 0 to 1 represents a time interval of one rotation of the press; distances from 0 to A and 0 to B, powdering times of the minimum and maximum sheets, respectively; and distances from 0 to C, 0 to D, and 0 to E, powdering times of the medium sheets, respectively.

An operation of the delivery apparatus having the above arrangement will be described below with reference to FIGS. 1 to 5 and FIG. 8. The printed sheet 7 is transferred from the grippers of the printing cylinder to the grippers 6 of the delivery chains 5 by the delivery cylinder 1 cooperating with the printing cylinder and is conveyed by movement of the delivery chains 5. The conveyed sheet 7 moves while its portion other than a gripped portion slides along the suction wheels 30 and therefore is chucked on the circumferential surface of the suction wheels 30. As a result, the sheet 7 is kept at high tension because its running speed is reduced, and its running inertia is also suppressed. Therefore, when the sheets 7 are released from the grippers 6 and dropped, they are stacked with their sheets ends being aligned well.

Upon such delivery, the air pump 40 is operated, the timing unit 48 detects the rotational speed of the printing press, and the potentiometer 45 detects the pivoting position of the operation shaft 22. Therefore, when the gripped end of the sheet 7 gripped by the grippers 6 reaches the nozzle pipe 13, the solenoid 43 is opened to start powdering, and powdering is continued for a predetermined time interval. Powdering of the printed surfaces prevents offset when the sheets are stacked.

If the sheet size is changed from, e.g., the maximum sheet 7 to the minimum sheet 7C, the handle 32 is manually operated to pivot the operation shaft 22. As a result, the racks 21 and the pinions 23 mesh with each other, and the suction wheels 30 together with the shafts 22 and 25 move toward the sprocket 4 to correspond to the minimum sheet 7C. Upon handle operation for moving the suction wheels 30, the potentiometer 45 detects a pivoting angle of the operation shaft 22 and generates a signal, and the signal is supplied to the control unit so that the solenoid 43 is closed earlier. Therefore, since the powdering time corresponds to the minimum sheet 7C, no unnecessary portion is powdered.

Figure 6:
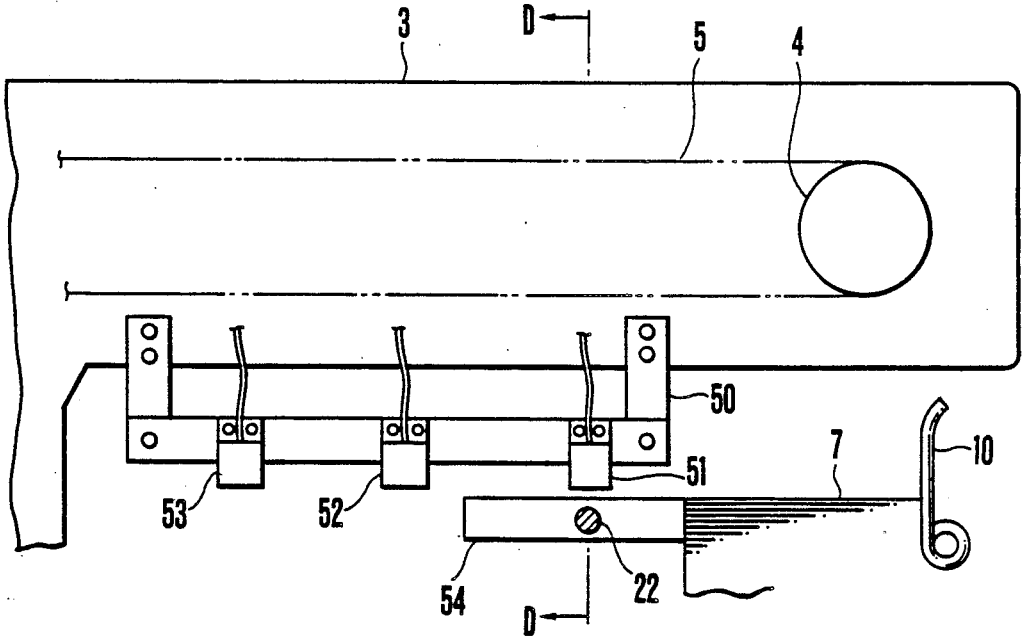
FIG. 6 is a side view showing a suction wheel moving amount detecting unit for explaining another embodiment of the present invention.
Figure 7:
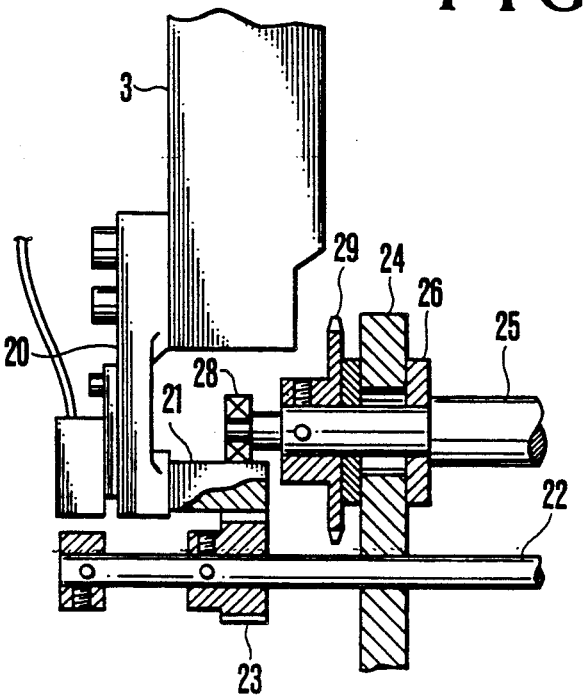
FIG. 7 is an enlarged longitudinal sectional view of the detecting unit taken along the line D—D in FIG. 6.

FIGS. 6 and 7 show another embodiment of the present invention. In FIGS. 6 and 7, the same reference numerals as in the first embodiment denote the same parts, and a detailed description thereof will be omitted. In the second embodiment, in place of the potentiometer 45 of the first embodiment, a proximity switch is used as a member for detecting a moving amount of a suction unit corresponding to a sheet size. That is, a bracket 50 fixed to and extending from a delivery frame 3 has a plurality of proximity switches 51, 52 and 53 as detectors aligned along a convey direction of sheets 7 with a predetermined interval therebetween. A transversely elongated rectangular detecting plate 54 is fixed at the shaft end portion of an operation shaft 22 and sequentially opposes the proximity switches 51, 52 and 53 when the operation shaft 22 horizontally moves in correspondence with the sheet size. When the detecting plate 54 opposes the proximity switches 51, 52 and 53, different signals are generated to allow a solenoid 43 to close in correspondence with the respective sheet sizes. With this arrangement, when the sheet size is changed, a handle 32 is manually operated to pivot the operation shaft 22 as described above. As a result, racks 21 and pinions 23 mesh with each other, and suction wheels 30 together with the operation shaft 22 and a suction wheel shaft 25 move along the conveying direction of the sheets 7. Therefore, the detecting plate 54 which has opposed, e.g., the proximity switch 51 then opposes the proximity switch 52 and generates a signal, thereby delaying a closing timing of the solenoid 43. As a result, a powdering time corresponding to a larger sheet size is set. In order to use the proximity switches, a position of the suction wheels 30 must be checked upon start. For this reason, the detecting plate 54 is elongated as described above. The detecting plate 54, therefore, sometimes opposes two proximity switches at the same time. Therefore, software must be so programmed as to preferentially select one of the signals. Alternatively, the position of the suction wheels may be stored in a memory when the apparatus is switched on. In this case, however, if an operator moves the suction wheels while the apparatus is switched off, he or she must move the suction wheels to the end and depress a reset switch.

As has been described above, according to the delivery apparatus for a sheet-fed printing press of the present invention, the detector for detecting a moving amount of the suction wheels adjusted in correspondence with a sheet size is electrically connected to the solenoid for opening/closing the air path of the powdering pipe through the control unit connected to the timing unit of the printing press. Therefore, a powdering time can be automatically set to correspond to a sheet size in association with movement of the suction wheels each time the sheet size is changed. As a result, operations such as adjustment of a cam need not be performed to largely improve operability. In addition, since the powdering time can be accurately set, powder is not wasted to reduce the powder amount, resulting in an economical advantage.

What is claimed is:

1. A delivery apparatus for a sheet-fed printing press having an electrical timing unit for detecting the rotational speed of the press, a powdering pipe suspended within a delivery convey path and connected to an air source through a powder container, and a plurality of delivery suction wheels aligned between said powdering pipe and a delivery stack board and adjectable in a sheet convey direction in accordance with a sheet size, said apparatus comprising:

an electrical detector for detecting adjusted position of said suction wheels and for generating a signal corresponding to the adjusted position;

an electrical control unit connected to said detector and the timing unit of said printing press for generating an electrical signal corresponding to the sheet size indicated by the adjustment of said suction wheels and a solenoid located between said powder container and said air source for opening an air path therebetween for only a time interval corresponding to the signal supplied from said control unit.

2. An apparatus according to claim 1, wherein said detector includes a potentiometer.

3. An apparatus according to claim 1, wherein said detector includes a plurality of proximity switches.

* * * * *

UNITED STATES PATENT AND TRADEMARK OFFICE

CERTIFICATE OF CORRECTION

PATENT NO. : 5,001,980

DATED : March 26, 1991

INVENTOR(S) : Toshiyuki Aoki, Toshi Ojima

It is certified that error appears in the above-identified patent and that said Letters Patent is hereby corrected as shown below:

Column 6

In claim 1, line 17, correct the spelling of the word "adjustable".

Signed and Sealed this

Third Day of November, 1992

*Attest:*

DOUGLAS B. COMER

*Attesting Officer*

*Acting Commissioner of Patents and Trademarks*